US005860873A

United States Patent [19]

Karasavas

[11] Patent Number: 5,860,873

[45] Date of Patent: Jan. 19, 1999

[54] GOLF SWING TRAINER

[76] Inventor: Peter Karasavas, 45 Vernon Ave., Eastlakes, New South Wales 2018, Australia

[21] Appl. No.: 687,484

[22] PCT Filed: Feb. 14, 1995

[86] PCT No.: PCT/AU95/00066

§ 371 Date: Nov. 4, 1996

§ 102(e) Date: Nov. 4, 1996

[87] PCT Pub. No.: WO95/21661

PCT Pub. Date: Aug. 17, 1995

[30] Foreign Application Priority Data

| | | | |
|---|---|---|---|
| Feb. 14, 1994 | [AU] | Australia | PM3842 |
| Nov. 14, 1994 | [AU] | Australia | PM9392 |
| Jan. 5, 1995 | [AU] | Australia | PN0383 |

[51] Int. Cl.[6] ..... A63B 69/36

[52] U.S. Cl. ..... 473/234; 473/282

[58] Field of Search ..... 473/234

[56] References Cited

U.S. PATENT DOCUMENTS

| | | | |
|---|---|---|---|
| 2,723,125 | 11/1955 | Comee | 473/234 |
| 3,136,546 | 6/1964 | Connolly | 473/234 |
| 3,498,616 | 3/1970 | Hurst | 473/234 X |
| 4,515,368 | 5/1985 | Petitjean . | |
| 4,541,631 | 9/1985 | Sasse . | |
| 4,577,868 | 3/1986 | Kiyonaga . | |
| 4,852,875 | 8/1989 | McLennan et al. . | |
| 5,161,802 | 11/1992 | Daechsel . | |
| 5,184,826 | 2/1993 | Hall, Jr. . | |
| 5,259,620 | 11/1993 | Marocco . | |

FOREIGN PATENT DOCUMENTS

| | | |
|---|---|---|
| 2337985 | 2/1975 | Germany . |

*Primary Examiner*—George J. Marlo
*Attorney, Agent, or Firm*—Leydig, Voit & Mayer, Ltd.

[57] ABSTRACT

A golf swing trainer includes a substantially transparent tubular body having ends for mounting on a free end of a handle of golf club, transverse to the handle. Two chambers within the body are respectively defined by opposed co-axial transparent inner cylinders. A circumferential guide track at an interior surface of the body between opposed ends of the cylinder provides a path for a metal ball. During swinging of a golf club, the ball moves between the chambers and the track, providing an audible indication of movement between the track and the two cylinders, alerting a golfer to alter the golf swing.

12 Claims, 4 Drawing Sheets

50
20
52
2
57

20
2
15
54
51
50
19
57
56

10
12
20
22
2
15
50
51
9
19
57
56

2
5
5
19
50
56

GOLF SWING TRAINER

The present invention relates to golf and in particular to a golf swing trainer.

The invention has been developed primarily for use with golf clubs and will be described hereinafter with reference to that application. However, it will be appreciated that the invention is not limited to this particular field of use and is also suitable for tennis rackets, cricket bats and other sporting implements.

It has long been a goal for golfers to reproduce either a text book or preferred swinging action when striking the ball. Hitherto, this has involved not only extensive practice, but the use of expensive video equipment and/or a coach to view the swinging action. Accordingly, much time and expense is involved.

The above problem is exacerbated because a slightly different swinging action is required for each of the different clubs used.

It is an object of the present invention, at least in the preferred embodiment, to overcome or substantially ameliorate this disadvantage of the prior art.

According to a first aspect of the invention there is provided a golf swing trainer including an axially extending tubular body for mounting to the handle of a golf club, two chambers disposed within and/or adjacent to the body, and a circumferentially extending guide track disposed within the body and between the chambers tracking means selectively supported by the guide track, wherein, during a predetermined swinging of the club the tracking means moves between the chambers and the guide track and provides an indication of the movement.

Preferably, the guide track extends around the interior of the body to define a circular path for the tracking means and the indication provided by the tracking means is audible.

Preferably, the body includes a centrally disposed radially extending mount for selectively engaging in an interference fit the free end of the handle.

Preferably also, the body is cylindrical and includes a first and a second tubular insert for defining the first and second chambers which extend coaxially from respective ends of the body and terminate adjacent to the centre of the body to define the guide track. More preferably, at least one of the tubular inserts is movable with respect to the body for selectively adjusting the axial extent of the track. Even more preferably, at least one of the inserts is threadedly engaged with the body and includes a locking collar for selectively securing the insert at a predetermined position with respect to the body.

Preferably, the body and inserts are produced from a transparent plastics and the tracking means is a spherical metal body. In alternative embodiments the body is aluminium.

According to a second aspect of the invention there is provided a swing trainer including an axially extending tubular body for mounting to the handle of a sporting implement, two chambers disposed within and/or adjacent to the body, and a circumferentially extending guide track disposed within the body and between the chambers for selectively supporting tracking means, wherein during a predetermined swinging of the implement the tracking means moves between the chambers and the guide track and provides an indication of the movement.

According to a third aspect of the invention there is provided a golf swing trainer including an axially extending tubular body for mounting to the handle of a golf club, said body including closed ends and housing tracking means for selectively striking the ends and providing an audible indication thereof during a predetermined swinging of the club.

According to another aspect of the invention there is provided a method of practicing a golf swing including the steps of:

mounting a trainer as described above to the handle of a golf club;

swinging the club;

observing the indications provided by the trainer; and thereafter either recreating or adjusting the swing in accordance with the timing of the indications.

A preferred embodiment of the invention will now be described, by way of example only, with reference to the accompanying drawing in which.

Figure 1:
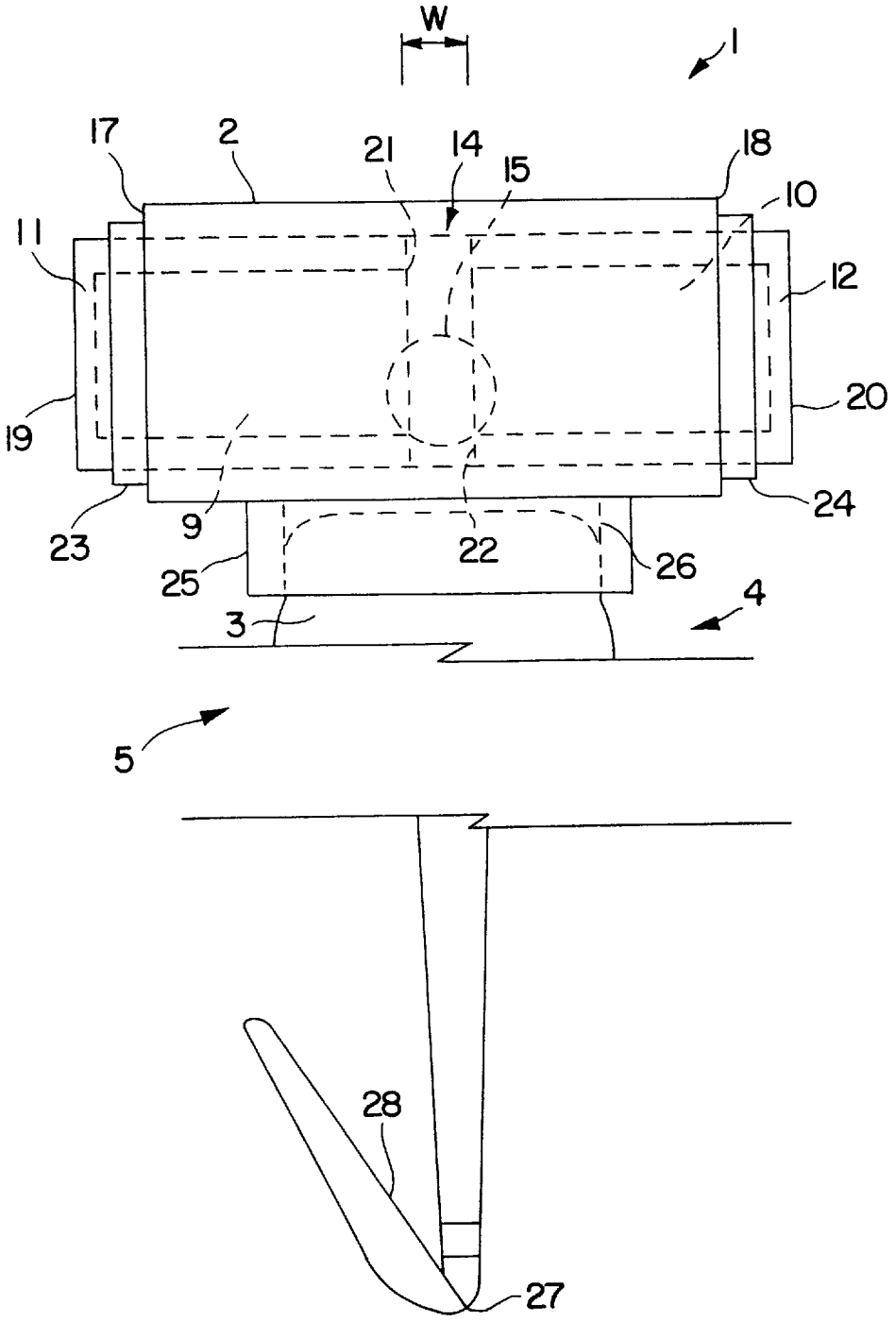
FIG. 1 is a schematic front elevation of a first embodiment of golf swing trainer according to the invention, mounted on a golf club.

Referring to FIG. 1, a golf swing trainer 1 includes an axially extending substantially transparent perspex or polycarbonate tubular body 2 for mounting to the free end 3 of the handle 4 of a golf club 5. Two chambers 9 and 10 are disposed within and adjacent to body 2 and are respectively defined by opposed coaxial inner cylinders 11 and 12, which are also produced from perspex or polycarbonate and are also substantially transparent. A circumferentially extending guide track 14 is disposed within body 2 between adjacent opposed ends of inner cylinders 11 and 12 for selectively supporting tracking means in the form of a spherical metallic ball 15. During a predetermined swinging of club 5, ball 15 moves between chambers 9 and 10 and track 14 while also providing an audible indication of that movement.

Body 2 is internally threaded and extends between a first end 17 and a second end 18, both of which are open for receiving respective cylinders 11 and 12. These cylinders 11 and 12 are externally threaded for engagement with body 2 and extend between respective outer closed ends 19 and 20, and respective inner opposed open ends 21 and 22.

Cylinders 11 and 12 also support respective lock nuts 23 and 24 which selectively abut against ends 17 and 18 of body 2 to maintain the cylinders in a predetermined configuration with respect to body 2. Accordingly, nuts 23 and 24 maintain the width W of track 14 at a predetermined value.

Body 2 includes a mount in the form of an annular ring 25 having an axis substantially normal to the axis of body 2 and parallel to the axis of handle 4. The inner surface 26 of ring 25 is adapted for engagement with the free end 3 in an interference fit. Preferably, the axis of body 2 is also substantially normal to the leading edge 27 of the club face 28.

Figure 2:
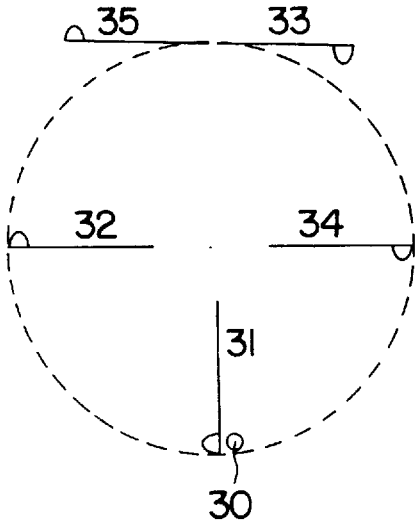
FIG. 2 is a diagrammatical representation of the club positions during different stages of a golf swing.
Figure 3:
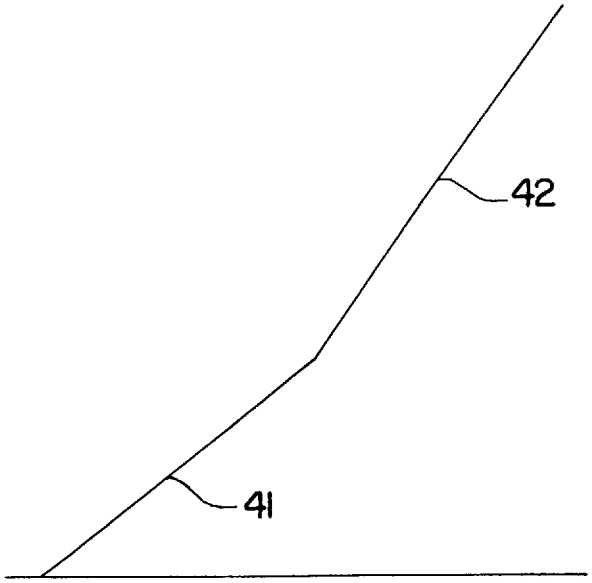
FIG. 3 is a schematic side view of FIG. 2 illustrating the initial plane and swing planes through which the club passes during a golf upswing.

To better understand the invention an explanation will be provided on a golf swing with particular reference to FIGS. 2 and 3. Initially, the player addresses a ball 30 with the leading edge 27 of club face 28 substantially parallel with the ground and the handle 4 maintained in a plane substantially normal to the ground. This configuration is schematically illustrated in FIG. 2 and designated position 31. The golfer then moves club 5 away from ball 30 to a position designated 32 where the leading edge is vertical. Movement from position 31 to 32 is referred to as the "take-away". During the take-away handle 4 remains substantially in the same plane 41, as best illustrated in FIG. 3.

Following the take-away the upswing continues until club 5 reachs position 33 or the top position. Due to the action of the golfer's body during movement from position 32 to 33, the shaft of club 5 moves through a swing plane 42, as best shown in FIG. 3. At position 33 handle 4 is substantially horizontal and leading edge 27 is parallel to the swing plane.

The downswing then involves movement of club 5 from position 33 through to 31 in a smooth progression to subsequently strike ball 30. The downswing is succeeded by the follow through The follow through includes two stages, one where the club moves from position 31 to position 34, and another between position 34 and 35. As with the upswing two different swing planes are utilised, the transition between the two planes occurring at position 34.

With trainer 1 mounted as shown in FIG. 1, a golfer can grip handle 4 and address ball 30 in the usual manner. Initially, it is preferable for ball 15 to be located in track 14. During the take-away, the golfer's wrist, arm and body action should ensure that ball 15 remains in track 14 although it will move along the track under the influence of gravity. Additionally, once club 5 proceeds past position 32, ball 15 remains located along track 14 until just prior to the club reaching position 33. At this position ball 15 should fall into chamber 9 because of rotation of the golfer's forearms which rotates handle 4 about its axis to tilt end 17 of body 2 downwardly.

Once ball 15 leaves track 14 and enters either one of chambers 9 or 10 it will produce an audible indication by hitting closed end 19 or 20 of inner cylinders 11 and 12 respectively. Should this audible indication be provided when the golfer believes position 33 has been reached then a text book upswing has been produced. An early or lack of audible indication will alert the golfer that the club has been moved in a manner not in accordance with a text book swing. Moreover, the timing or not of the audible indication will allow the golfer to be aware of that part of the swing where the error occurred. For example, during the upswing, should ball 15 leave track 14 prior to reaching position 33 then the swing plane is either too flat or too steep, depending upon which chamber ball 15 enters. More particularly, if the ball enters chamber 9 the swing plane is too flat. Conversely, should ball 15 enter chamber 10 the swing plane is too steep.

Once position 33 has been reached ball 15 should move into chamber 9. Should the ball remain in the track or fall into the other chamber, the swing plane is too steep.

It will be appreciated that trainer 1 will also provide the golfer with an audible indication should the take-away be jerky or otherwise incorrect.

During the downswing, ball 15 will remain in chamber 9 until club 5 has progressed back past position 32. When the club is approximately half way between positions 32 and 31, ball 15 will move into chamber 10. Thereafter, ball 15 remains in chamber 10 until the club is positioned approximately half way between positions 31 and 34, when it moves back into chamber 9.

As the follow through continues the rotation of the golfer's forearms, and subsequent rotation of club 5, causes ball 15 to move into chamber 10 as the club moves past position 34.

Ball 15 provides both an audible and physical indication of its movement in body 2. Accordingly, the golfer obtains instant feedback on the timing and correctness of the swing.

The timing of movement of ball 15 between the chambers can be used to provide an indication of any error that is occurring at a particular part of a swing. The following examples are provided.

EXAMPLE 1.

HOODED OR CLOSED CLUBFACE

During the take-away, ball 15 moves into chamber 10 where it remains until club 5 reaches position 32. Thereafter, ball 15 moves into chamber 9. During the downswing ball 15 moves back into chamber 10 prior to club 5 passing through position 32, which is much earlier than would occur with a text book swing. Additionally, during the follow through, ball 15 will not move into chamber 9 until after position 34, that is, later than would occur with a text book swing. Shortly after that movement, ball 15 will again move into chamber 10. When extreme hooding of the club face occurs, the two last mentioned movements occur in quick succession or do not occur at all.

EXAMPLE 2.

OPEN CLUBFACE

Movement of ball 15 into chamber 9 during the take-away or the remainder of the upswing indicates an open clubface. During the downswing, ball 15 will move into chamber 10 at or near position 31, and then move back into chamber 9 immediately after club 5 reaches position 31. That is, movement from chamber 9 to 10, and then from 10 to 9 occurs in quick succession, and later and earlier respectively than with a text book swing. Additionally, during the follow through ball 15 will not return to chamber 10 until club 5 is well past position 34.

For an extremely open clubface only one click is produced during the downswing and follow through. In such circumstances the sound is produced once club 5 is well past position 34.

The sequences described above are for a moderate swing speed and where a golf ball is not struck. Timing variations also arise due to each particular golfer's wrist action.

The earlier the movement of ball 15 between chamber 9 and 10 during the downswing the more hooded the clubface. Conversely, the later that movement the more open the clubface. The text book swing causing movement of ball 15 at an intermediate position.

During the follow through an early and late first movement indicates an open and closed club face respectively, while the text book swing causes movement of ball 15 intermediate the extremes.

The rhythm produced by the ball 15 during the swinging motion provides the golfer with immediate feedback of the smoothness or othervise of the swing.

Device 1 can also be used to allow reproduction of a desirable swing which may not be a text book swing. That is, a golfer can use the timing of the audible indications as a guide for replication of a desired shot.

The invention is suitable for use with all golf clubs. More particularly, golf irons having high numbers have short shafts and are swung in a steep swing plane, while irons having lower numbers have longer shafts and are swung in shallower swing planes. Woods include even longer shafts, and accordingly, are swung in a relatively flat swing plane. To accommodate these different swing planes device 1 allows adjustment of the width W of track 14. That is, for the flatter swing lane the width of track 14 is increased so that ball 15 is more securely retained within track 14 whereby during the backswing ball 15 will remain in the track until the club almost reaches position 33.

The width is adjusted by threading either or both of cylinders 11 and 12 with respect to body 2 and re-tightening nuts 23 and 24 once the desired width has been obtained. Preferably, track 14 remains centrally disposed within body 2.

Width adjustment of track 14 is also used to vary the sensitivity of trainer 1. For more advanced golfers a greater sensitivity is used (by decreasing the track width) so that slight deviations from an ideal swing will be indicated.

A very narrow track width can also be used to refine a particular part of the swing. For example, the golfer can concentrate on the take-away only.

In alternative embodiments only one of cylinders 11 and 12 is adjustable. Moreover, many locking means other than nuts 23 and 24 are available. In less preferred embodiments, no adjustment is provided.

An alternative to width adjustment of track 14 is to provide a plurality of balls 15 of different diameter suitable for use with a particular club.

In the illustrated embodiment cylinders 11 and 12 extend beyond body 2 and accordingly chambers 9 and 10 and disposed both within and adjacent to the body. Alternative embodiments utilise shorter cylinders 11 and 12 whereby chambers 9 and 10 are located wholly within body 2. Further alternative embodiments include a very short body and, accordingly, chambers 9 and 10 are disposed coaxial with, although substantially adjacent to, the body.

Although body 2 and cylinders 11 and 12 are preferably transparent, other embodiments are coloured and/or opaque. Additionally, body 2 can be other than cylindrical, and may be square, rectangular or polygonal in cross-section, and, accordingly, will produce additional audible indications upon movement of club 5.

Trainer 1 can also be integrally incorporated into a club either at end 3 or elsewhere along the club shaft. In less preferred embodiments, the trainer is strapped or otherwise secured to a golfer's hand or wrist. The movement of ball 15 will, however, provide an indication of the golfer's wrist movement rather than that of the club. For other sporting implements this mounting method can be more preferable.

Additionally, trainer 1 can be similarly mounted to other sporting implements and tailored for the particular desired swings.

In some embodiments, trainer 1 is configured to provide an electrical signal indicative of the position of the tracking means. That is, whether ball 15 is disposed within either of chambers 9 to 10 or track 14. This signal is subsequently used to provide and audible or other indication of movement of the club. For example, the signal can trigger one of a plurality of appropriately placed lights.

Some embodiments include ends 19 and 20 which are of different thicknesses such that when struck by ball 15 a sound of different pitch is produced. Accordingly, the golfer is immediately provided with feedback on the swing being taken without the need for visual confirmation.

Reference is now made to FIGS. 4 to 10 which illustrate three other embodiments of the invention, where corresponding features are denoted by corresponding reference numerals. More particularly, reference is made to FIGS. 4 to 8 and the trainer 50 which includes a body 2 having an integrally formed chamber 9 and an opposed threadedly engaged inner cylinder 12 defining chamber 10. The tracking means is defined on one side by a lip 51 and on the other by end 22 of cylinder 12.

Figures 4, 5, 6, 7:
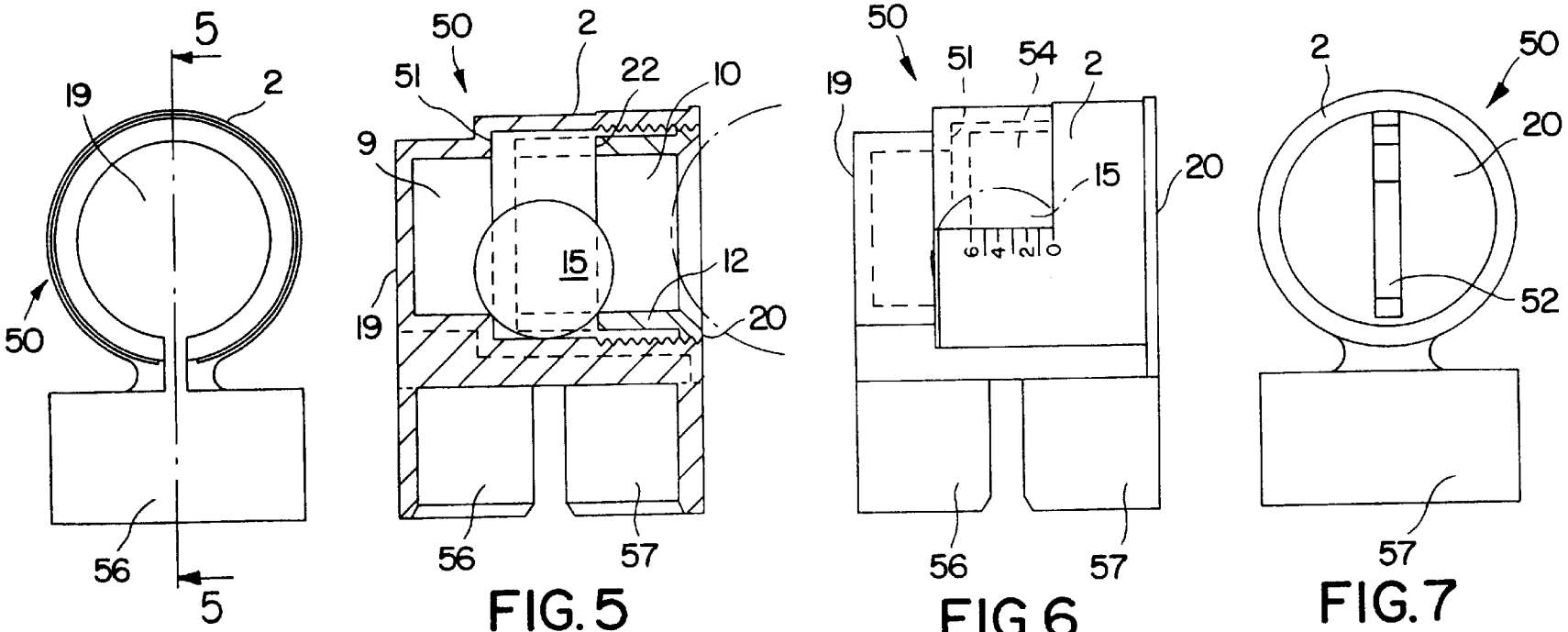
FIG. 4 is a side view of a second embodiment of the invention.
FIG. 5 is a sectional view taken on line 5—5 of FIG. 4.
FIG. 6 is a front view of the trainer of FIG. 4.
FIG. 7 is a side view of the trainer of FIG. 4, from the opposite end.

As best shown in FIG. 5, closed end 20 includes a slot 52 for receiving a coin (ghosted) or the like to facilitate threaded advancement of cylinder 12 along body 2. The extent of the advancement is easily quantifiable due to indicia located on body 2.

FIG. 5 illustrates trainer 50 configured for the widest track possible. The position of end 22 in the narrowest track configuration is shown in outline for illustrative purposes.

In this embodiment, trainer 50 is opaque except for a semi-circular transparent plastic window 54. Other embodiments may be fully transparent, as required.

Trainer 50 includes mounting means in the form of two crescent shaped opposed flanges 56 and 57 which resiliently deform and engage the free end 3 (ghosted in FIG. 8) of handle 4.

Figure 9:
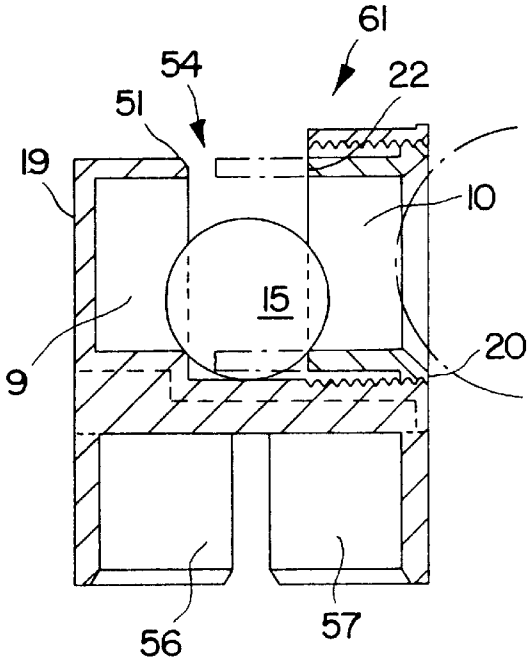
FIG. 9 is a sectional view similar to FIG. 5 of a third embodiment of the invention.
Figure 8:
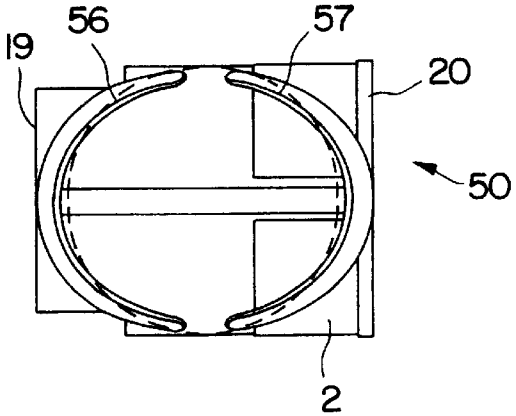
FIG. 8 is a bottom view of the trainer of FIG. 4.

Referring to FIG. 9, a third embodiment of the invention is illustrated. Trainer 61 is the same as trainer 50 with the exception that window 54 is defined by an absence of body 2. Accordingly, ball 15 is directly viewed. Otherwise, the function of the trainer remains unchanged.

Ball 15 remains retained within body 2 because the axial extent of track 14 is insufficient to allow the ball to escape.

This configuration is particularly advantageous because the sound produced by ball 15 when striking either end 19 or 20 freely emanates through the window.

Figure 10:
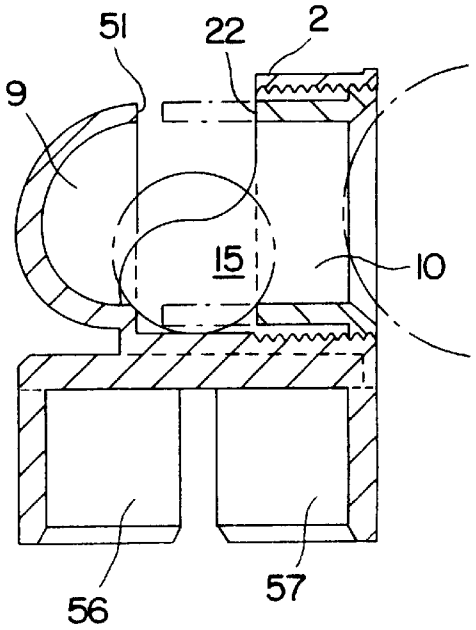
FIG. 10 is a sectional view similar to FIG. 5 of another embodiment of the invention.

A further embodiment of the invention is illustrated in FIG. 10. Body 2 includes a chamber 9 defined by a hemispherical wall. Again, the function of the trainer is identical to the other embodiments described above.

A trainer constructed in accordance with the invention provides a cheap and effective device for allowing a golfer to practice and replicate either a text-book or desired swing. It is not necessary for the golfer to actually hit a golf ball while practicing, although the device can be used while playing.

Use of the trainer also encourages a golfer to correctly rotate his torso to produce the desired swinging action which in turn produces a clear, distinct and correct sequence of audible indications.

In a less preferred embodiment trainer 1 includes an axially extending tubular body for mounting to the handle of a golf club. The body includes closed ends and houses tracking means in the form of a spherical metal ball. The ball selectively strikes the ends and provides an audible indication thereof during a predetermined swinging of the club. It will be appreciated that this trainer will not allow the take-away to be analysed due to the absence of a track to initially retain the ball centrally within the body. Neither is it possible to correctly determine the inclination of the swing plane.

Although the invention has been described with reference to specific examples, it will be appreciated by those skilled in the art that the invention may be embodied in many other forms.

I claim:

1. A golf swing trainer including:

a tubular body having a central axis, a wall having interior and exterior surfaces, closed ends, first and second opposed chambers disposed along the central axis, and a circumferential guide track at the interior wall, concentric with the central axis and separating the first chamber from the second chamber;

means for mounting the tubular body on a handle of a golf club with the central axis transverse to the handle of the golf club; and tracking means freely movable within and between the guide track, the first chamber, and the second chamber for following a path along the guide track and moving between the guide track, the first chamber, and the second chamber, wherein, during swinging of the golf club, in response to the swinging of the golf club, the tracking means moves between the first chamber, the second chamber, and the guide track, providing an indication of movement of the tracking means between the guide track, the first chamber, and the second chamber.

2. The golf swing trainer according to claim 1 wherein the guide track extends on the interior surface of the body in a circular path.

3. The trainer according to claim 1 wherein the indication provided by the tracking means is audible.

4. The golf swing trainer according to claim 1 wherein the mounting means includes a centrally disposed mount extending radially from the body, with respect to the central axis, for engaging, in an interference fit, a free end of the handle.

5. The golf swing trainer according to claim 3 wherein the body is cylindrical and including a first end cap and a second end cap respectively defining ends of the body and the first and second chambers, the first and second end caps extending co-axially from respective ends of the body and terminating centrally within the body, thereby defining the guide track.

6. The golf swing trainer according to claim 4 wherein at least one of the first and second end caps is movable with respect to the body for selectively adjusting a width of the guide track.

7. The golf swing trainer according to claim 4 wherein at least one of the first and second end caps threadedly engages the body and including a locking collar for selectively securing the end cap threadedly engaged with the body at a fixed position with respect to the body.

8. The golf swing trainer according to claim 6 wherein the body and the first and second end caps are transparent plastic and the tracking means is a spherical metal body.

9. The golf swing trainer according to claim 1 wherein the tracking means comprises a spherical metal body.

10. A swing trainer including:

a tubular body having a central axis, a wall having interior and exterior surfaces, closed ends, first and second opposed chambers disposed along the central axis, and a circumferential guide track at the interior wall, concentric with the central axis and separating the first chamber from the second chamber;

means for mounting the tubular body on a handle of a sporting implement with the central axis transverse to the handle of the implement; and tracking means freely movable within and between the guide track, the first chamber, and the second chamber for following a path along the guide track and moving between the guide track, the first chamber, and the second chamber, wherein during swinging of the implement, in response to the swinging of the implement, the tracking means moves between the first chamber, the second chamber, and the guide track, providing an indication of movement of the tracking means between the guide track, the first chamber, and the second chamber.

11. The swing trainer according to claim 9 wherein the tracking means comprises a spherical metal body.

12. A method for practicing a golf swing including:

mounting a golf swing trainer on a handle of golf club, the golf swing trainer including:

a tubular body having a central axis, a wall having interior and exterior surfaces, closed ends, first and second opposed chambers disposed along the central axis, and a circumferential guide track at the interior wall, concentric with the central axis and separating the first chamber from the second chamber; and tracking means freely movable within and between the guide track, the first chamber, and the second chamber for following a path along the guide track and moving between the guide track, the first chamber, and the second chamber, wherein during swinging of the golf club, in response to the swinging of the golf club, the tracking means moves between the first chamber, the second chamber, and the guide track, providing an indication of movement of the tracking means between the guide track, the first chamber, and the second chamber, the central axis being transverse to the handle of the golf club;

swinging the golf club;

observing the indications provided by the tracking means; and re-creating or adjusting the swing in accordance with the indications.

* * * * *

UNITED STATES PATENT AND TRADEMARK OFFICE

CERTIFICATE OF CORRECTION

PATENT NO. : 5,860,873

DATED : January 19, 1999

INVENTOR(S) : Peter Karasavas

It is certified that error appears in the above-identified patent and that said Letters Patent is hereby corrected as shown below:

Column 7, Line 34, change "3" to --4--;

Line 41, change "4" to --5--;

Line 45, change "4" to --5--;

Line 50, change "6" to --7--;

Column 8, Line 24, change "9" to --10--.

Signed and Sealed this

Twentieth Day of July, 1999

*Attest:*

*Attesting Officer*

Q. TODD DICKINSON

*Acting Commissioner of Patents and Trademarks*